US005228374A

United States Patent [19]

Santeramo, Sr.

[11] Patent Number: 5,228,374

[45] Date of Patent: Jul. 20, 1993

[54] TABLE SAW FENCE ASSEMBLY

[76] Inventor: Joseph J. Santeramo, Sr., 185 Walnut St., Teaneck, N.J. 07666

[21] Appl. No.: 743,441

[22] Filed: Aug. 9, 1991

[51] Int. Cl.[5] ..... B26D 7/06

[52] U.S. Cl. ..... 83/438; 83/477.2; 83/522.19

[58] Field of Search ..... 83/467.1, 438, 468, 83/468.7, 477.2; 33/470, 464, 430, 42, 23.03; 16/105, 106

[56] References Cited

U.S. PATENT DOCUMENTS

| | | | |
|---|---|---|---|
| 462,419 | 11/1891 | Wehner | 83/438 |
| 785,699 | 3/1905 | Bemis | 83/438 |
| 816,424 | 3/1906 | Bemis | 83/438 |
| 836,006 | 11/1906 | Bemis | 83/438 |
| 883,798 | 4/1908 | Gregory | 33/23.03 |
| 1,789,125 | 1/1931 | Wilderson | 83/438 |
| 3,661,431 | 5/1972 | Wisecarver | 16/87 R X |
| 4,909,114 | 3/1990 | Astle | 83/564 X |

OTHER PUBLICATIONS

Dual Vee Brochure, Industrial V-Guide Wheels and Track, Manufactured by Bishop-Wisecarver Corporation.

*Primary Examiner*—Frank T. Yost
*Assistant Examiner*—Clark F. Dexter
*Attorney, Agent, or Firm*—Charles J. Brown

[57] ABSTRACT

A table saw fence assembly wherein a fence element is connected in a "T" arrangement across the end of a slide blade which is reciprocable linearly between guide wheels on a base affixed to the top of a saw table, preferably directly above the saw blade axis when the saw blade axis is horizontal.

1 Claim, 1 Drawing Sheet

TABLE SAW FENCE ASSEMBLY

BACKGROUND OF THE INVENTION

Table saw fences provide a straight working edge or face on a saw work table spaced in a selected position from a circular saw blade to guide a workpiece as it is pushed into cutting engagement with the blade, thus producing a sawn piece of predetermined width. It is important, of course, that the working face of the fence be as parallel as possible to the chord line of the segment of the saw blade projecting above the work table.

Prior art table saw fences include straight elongated fence elements slidable only at one end along a track fixed to the front edge of the work table, as disclosed for example in U.S. Pat. Nos. 4,206,910 and 4,600,184. However, with the remote end of the fence toward the rear of the table beyond the blade left unrestrained, inevitable play between the sliding parts of the fence element and the track at the front edge of the table may cause the unrestrained rear end of the fence to wobble ever so slightly, thus departing from the true parallelism desired between the fence working face and the chord of the blade segment.

This problem is addressed in other prior art fence designs by slidably mounting both the front and the rear ends of the fence on respective tracks on the front and rear edges of the table. The result is a doubling of the parts required for the slidable mounting. Another disadvantage in double track forms of fence is that it is difficult to insure that the pair of tracks are mounted exactly parallel to one another and remain that way. If they are not parallel either the fence attempting to slide on the non-parallel tracks will bind or play must intentionally be provided in the sliding parts to prevent binding, and that again introduces the possibility of wobble and non-parallelism between the working face of the fence and the saw blade segment chord. Double track forms of fences are described in the aforementioned U.S. Pat. No. 4,600,184.

Fence designs of the prior art have not contemplated joining together the fence and "track" in one T-shaped unit and then moving the track back and forth in a single fixed guide. This would avoid the problem of double guides at opposite ends of the fence and would allow the single guide to be placed on the table itself aligned over the saw blade axis that there would be no unrestrained fence end remote from the slidable mounting. Prior art fence designs also fail to take advantage of the technology of adjustable V-guide wheels and tracks for precise linear motion.

SUMMARY OF THE INVENTION

The invention provides a fence assembly for a table saw having a circular blade rotatable about a blade axis with a segment partly defined by a chord projecting above a flat work table. The fence assembly includes a base securable to the flat work table. At least three co-planar guide wheels are mounted on the base with their axes of rotation perpendicular to the table. At least one of the wheels is spaced to one side of a travel line co-planar with the wheels and perpendicular to the wheel axes and the remaining wheels are equally spaced to the opposite side of that travel line. An elongated slide blade is included having parallel edges rollably engaged by the wheels and translatable linearly along the travel line toward and away from the saw blade. An elongated fence element is attached across one end of the slide blade with a straight working face disposable at selected fixed positions between the base and the saw blade perpendicular to the travel line and parallel to the saw blade segment chord.

In a preferred form of the invention the travel line is directly above and parallel to the saw axis when the saw axis is horizontal. It is also preferred that the wheels be V-guide wheels receiving projecting V-guide tracks formed in the edges of the slide blade.

There may be at least two opposed pairs of the wheels with the wheels of each pair spaced equally apart on opposite sides of the travel line. The axis of one of the wheels of each pair may be fixed and the axis of the other may be adjustable to bring the slide blade in snug rolling engagement therebetween. A hand-operated circular adjustment knob may extend upwardly from one of the wheels for fine adjustment of the slide blade position. Locking means may be provided on the base to hold the slide blade in a selected fixed position and a cam-actuated lock may be utilized for that purpose. The fence element may be adjustably secured to the slide blade to permit fine parallel alignment of the fence working face with the saw blade segment chord. Sensor and read-out means may be provided for measuring the distance of the fence working face from the saw blade segment chord and displaying that measurement information.

During a sawing operation the force of the workpiece against the fence element along the length of its working face is equivalent to a single force vector acting against the fence element at about its mid-point or approximately at the saw blade. In prior art fence assemblies where the fence element is supported only at one end at the front of the saw table this vector applies a bending moment to the fence element about its end support which gives rise to possible angular displacement or wobble at the unrestrained remote end thereof. This is avoided in the design of the invention because that vector is aligned with the travel line of the slide blade behind the fence element and therefore imposes no significant bending moment on either the fence element or the slide blade. Parallelism between the fence element and the saw blade segment chord is therefore more readily maintained in the assembly of the invention.

Another advantage of the invention is that the co-planar wheels with their rotation axes perpendicular to the table give full assurance that the slide blade remains parallel to the table and therefore the fence element never lifts off the table surface, as it sometimes does in prior art assemblies where the fence element is supported only at one end at the front of the saw table.

In addition the use of guide wheels against the slide blade edges, rather than sliding shoes as in the prior art, allows the blade to be moved with very little rolling friction even though it is snugly restrained with no clearance or play between it and the wheels.

DESCRIPTION OF PREFERRED EMBODIMENT

Figure 3:
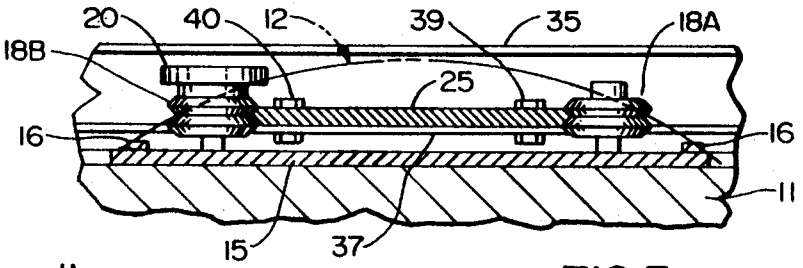
FIG. 3 is an enlarged fragmentary section taken along the line 3—3 of FIG. 1.

The fence assembly of the invention is used in combination with a table saw having a table 10 provided with an extension 11 together referred to herein as the work table of the saw. A segment 12 of a circular saw blade extends through a slot in the table 10 and is partly defined by a chord line which is the line of intersection between the plane of the saw blade and the upper surface of the table 10. As described in detail below, the fence assembly of the invention is to be positioned on the work table and locked at pre-determined distances from the saw blade 12 to accurately determine the position of a cut in a workpiece (not shown). The saw blade 12 is rotatable about a blade axis which is typically tiltable. The axis is parallel to the surface of the work table 10 and horizontal when positioned to make a perpendicular cut through the workpiece.

A rectangular base 15 is bolted to the extension table 11 by four corner bolts 16. Two pairs of opposed co-planar guide wheels 18A and B and 19A and B are rotatably mounted on the base 15. These wheels are of a kind known as V-wheels, as manufactured for example by Bishop-Wisecarver Corp. of Pittsburg, California, U.S.A. The wheels include inner and outer races with appropriate ball bearings and cages therebetween. One wheel of each pair, 18A and 19A in the present embodiment, may be mounted eccentrically with respect to its circumference so that when turned slightly its axis of rotation moves toward or away from the stationary axis of the wheel 18B or 19B. A hand-operated adjustment knob 20 extends upwardly from the stationary wheel 18B and is provided with a cylindrical rubber or knurled circumferential surface to aid in gripping.

Figure 2:
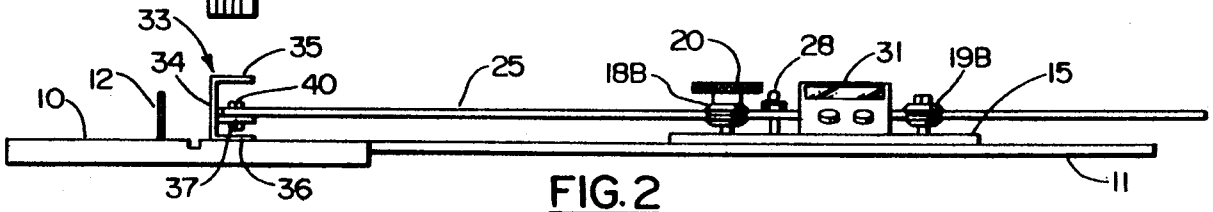
FIG. 2 is a side elevation of the fence assembly of the invention.

The wheels of each pair 18A and B and 19A and B are spaced equally apart on opposite sides of a travel line 22 which is a co-planar with the mid-section of the wheels 18A and B and 19A and B and perpendicular to their axes of rotation. The saw blade axis is not visible in the drawings because it is well below the underside of the work table as seen in FIG. 2 but when horizontal it is parallel to and directly below the travel line.

An elongated slide blade 25 is provided which has extended parallel edges formed with projecting V-tracks 26A and 26B. The track edges 26A and B mate with the V-wheels 18A and B and 19A and B so that the slide blade 25 is snugly engaged by the guide wheels. The blade itself is readily translated linearly toward and away from the saw blade 12 always in alignment with the travel line 22.

A conventional cam-actuated lock 28 is mounted on the base 15 to hold the slide blade 25 in a selected fixed position with respect to the work table. Representative forms of such cam-actuated locks are shown in the aforementioned U.S. Pat. Nos. 4,206,910 and 4,600,184.

A digital sensor 30 is mounted on the base 15 to read measurement information along the edge portion of the underside of the slide blade 25. That information is displayed in a digital read-out device 31. Such digital read-out and sensor systems are conventional and available from the Delta International Machinery Corporation of Pittsburgh, Pennsylvania, U.S.A., as described in U.S. Pat. Nos. 4,873,770, 4,961,269 and 4,982,509.

An elongated fence element 33 is attached across one end of the slide blade 25 with a straight working face 34 disposed at selected fixed positions between the base 15 and the blade 12 perpendicular to the travel line 22 and parallel to the chord of the saw blade segment 12. As shown particularly in FIG. 2 the face element 33 is of an E-shaped cross section having upper and lower flanges 35 and 36 to either side of a central flange 37. The end portion of the slide blade 25 closest to the saw blade 12 is bolted to the central flange 37 of the fence element by adjustable bolts 39 and 40 which permit fine adjustment of the fence element 33 to cause it to be in close parallel alignment with the chord of the blade segment 12.

Figure 1:
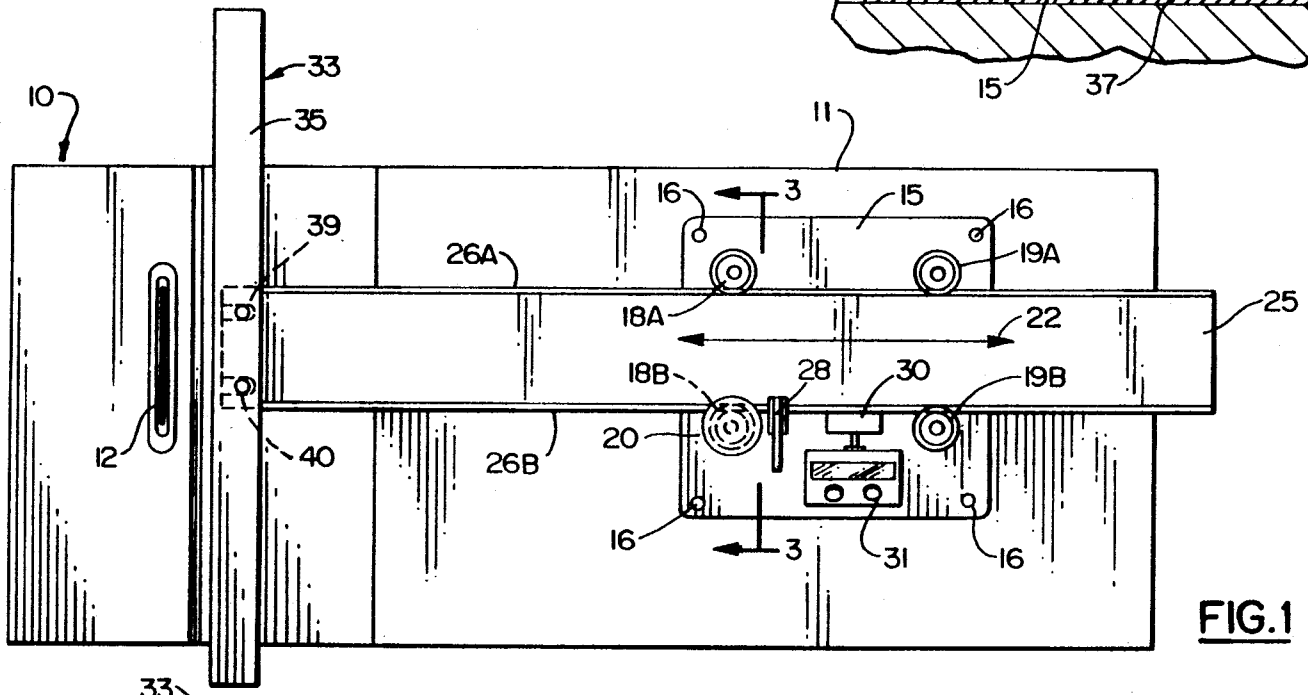
FIG. 1 is a plan view of the fence assembly of the invention.

In operation the base 15 is bolted to the saw extension table 11 with the face 34 of the fence element 33 approximately aligned parallel to the chord of the saw blade segment 12. Final adjustment of the fence element 33 is accomplished by loosening the bolts 39 and 40 holding the fence 33 to the slide blade 25 until the working face 34 of the fence element is exactly parallel to the chord of the segment 12 and then re-tightening the bolts 39 and 40. The fence element 33 is then moved so that its working face 34 engages the saw blade segment 12 and the digital read-out device 31 is turned on with a display mode selected in fractions or in English or metric units. The slide blade 25 is then moved to the right as seen in FIG. 1 until the desired dimension is indicated on the read-out 31. Fine adjustments in the last positioning of the slide blade 25 may be made by operation of the adjustment knob 20. The cam-lock 28 is then operated to secure the slide blade 25 and fence 33 in place. After many successive operations of the fence assembly it may be desirable to adjust the axes of the wheels 18A and 19A to insure that the two pairs of wheels snugly engage the tracks 26A and 26B on the edges of the slide blade 25.

It will be evident that the fence element 33 and slide blade 25 together form a "T-square" assembly with the leg thereof or slide blade 25 aligned facing the segment 12 of the saw blade and along the travel line 22 which is directly over and parallel to the axis of the saw blade when that axis is horizontal. This insures that the cross bar of the "T" or fence element 33 is presented to the saw blade in a head-on fashion and any force of the workpiece against the fence element 33 is vectored along the travel line 22 without imposing significant bending moments on the moveable engagement between the guide wheels 18A and B and 19A and B and the slide blade 25. For the reasons mentioned earlier this is an improvement over fences slideably mounted at one end along the front edge of the saw table.

The scope of the invention is to be determined by the following claims rather than the above description of the preferred embodiment.

I claim:

1. A fence assembly for a table saw wherein a circular blade rotatable about a blade axis has a segment partly defined by a chord projecting above a flat work table, said fence assembly comprising a) a base securable to the flat work table, b) at least three co-planar guide wheels mounted on the base with their axes of rotation perpendicular to the table and with at least one of the wheels spaced to one side of a travel line co-planar with the wheels and perpendicular to the wheel axes and with the remaining wheels equally spaced to the opposite side of that travel line.

c) an elongated slide blade having parallel edges rollably engaged by the guide wheels and translatable linearly along said travel line toward and away from the saw blade, d) an elongated fence element attached across one end of the slide blade with a straight working face disposable at selected fixed positions between the base and the saw blade perpendicular to the travel line and parallel to the saw blade segment chord, and e) a hand operated adjustment knob extending upwardly from one of the wheels for fine longitudinal adjustment of the slide blade position.

* * * * *